United States Patent [19]

Powell

[11] 4,130,951

[45] Dec. 26, 1978

[54] ILLUMINATED DANCING SHOES

[76] Inventor: Aaron Powell, P.O. Box 2331, Hollis N.Y. 11423

[21] Appl. No.: 831,960

[22] Filed: Sep. 9, 1977

[51] Int. Cl.[2] ..... A43B 23/00

[52] U.S. Cl. ..... 36/137

[58] Field of Search ..... 36/137; 362/103

[56] References Cited

U.S. PATENT DOCUMENTS 3,893,247 7/1975 Dana ..... 36/137

FOREIGN PATENT DOCUMENTS 1072485 9/1974 France ..... 36/137

444392 3/1936 United Kingdom ..... 36/137

*Primary Examiner*—Patrick D. Lawson

*Attorney, Agent, or Firm*—Marianne Rich

[57] ABSTRACT

Shoes for dancing in which the heel is made of hollow plastic and contains a battery powered flashlight for illuminating a compartment therein, having light transmitting holes in a side wall, covered with a translucent name label; and a light port at the front of the heel for energizing a bundle of light carrying optical fibers, extending ythrough and embedded in the sole via branches that end in small light emitting faces spaced around the edge of the sole; and a manual switch in the front wall of the heel for enabling an energizing circuit for the flashlight, containing a spring opened pressure switch having a switch contact-roller, the rim of which normally is slightly below the bottom of the heel, but closes the pressure switch when the shoe is stood on by the wearer, energizing the flashlight with each ta, and producing a series of flashes from the sole.

9 Claims, 5 Drawing Figures

ILLUMINATED DANCING SHOES

BACKGROUND OF THE INVENTION

This invention relates to illuminated shoes, and more particularly to disco dancing shoes having heel compartments containing battery powered flashlights.

It has been proposed to provide the heel of a shoe with a battery that energizes a lamp at the front of the shoe when a switch is closed. Also, hollow heels containing illuminating means have been proposed.

The main object of this invention is to provide an illuminated shoe for dancing, such as disco, and/or precision type dancing employing the shoe heels, which flashes each time the heel collides with the floor, through light posts in one side of each heel, as well as from small light emitting areas spaced around the edges of each sole.

Another object is to provide a light flashing heel for a shoe, carrying a transparent, personal identification label of the wearer's name illuminated by a flashing light during use of the shoe in disco dancing, as well as walking, or running.

SUMMARY OF THE INVENTION

The sole of a disco dancing shoe is provided with a flexible plastic sole having light transmitting optical fibers consisting of a bundle at the rear of the sole, extending via branches to the front and side edges of such sole, for carrying light from the end of such bundle, to small, spaced light emitting faces contiguous with the edge of the sole. The rear of the sole mates with the front of the heel of the shoe, which is hollow, and contains a battery powered flashlight behind a compartment, illuminated when the battery-lamp circuit is closed. A manually closed switch is located in the front heel wall, for enabling energization of the lamp, upon closure of a pressure switch on the bottom of the heel, lighting the lamp with a flash, each time the heel collides with the floor during a disco dance by the wearer. Small light port holes in the heel side wall, are covered with a transparent translucent plastic name label mounted thereover. The heel and sole flash small beams of light each time the heel hits the floor.

DETAILED DESCRIPTION OF THE INVENTION

Figure 1:
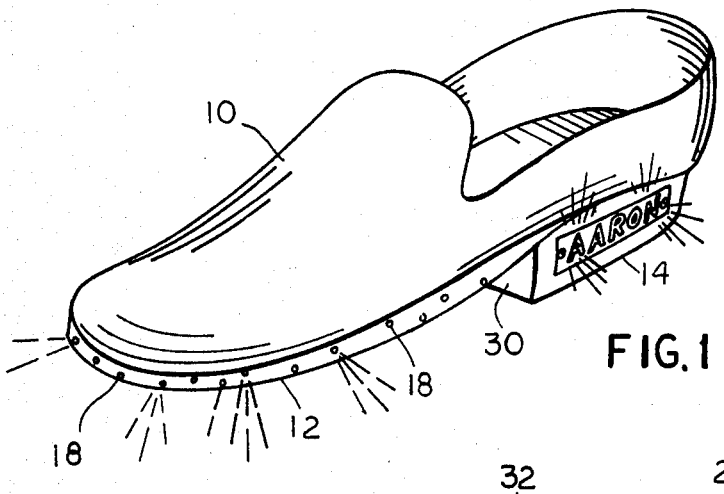
FIG. 1 is a perspective view of a disco shoe embodying the invention.
Figure 2:
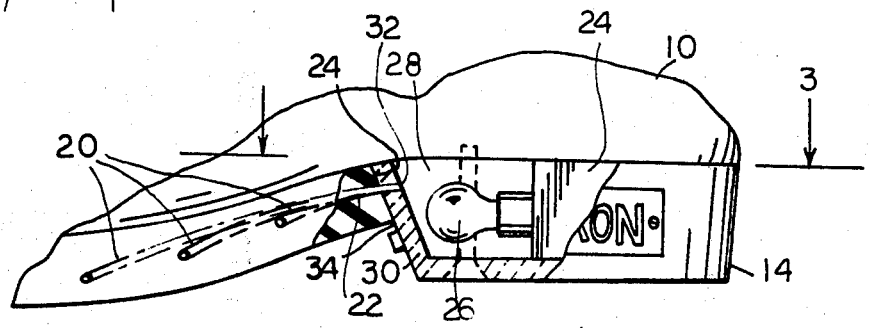
FIG. 2 is an enlarged fragmentary view in side elevation of the shoe, with parts broken away and shown in section.
Figure 3:
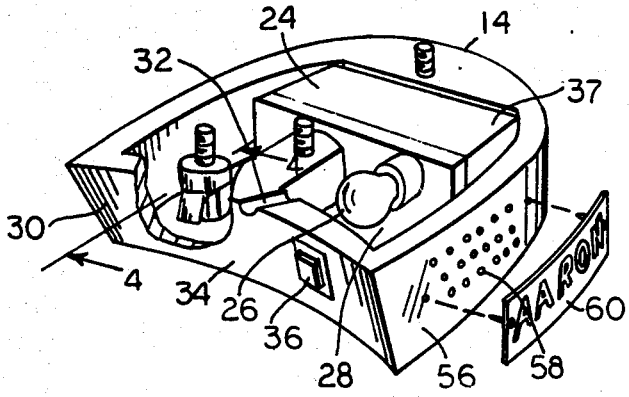
FIG. 3 is an exploded view in perspective of the heel, taken on line 3—3 of FIG. 2.

Referring to FIG. 1, disco dancing shoe 10 comprises a sole 12 and a heel 14. The sole 12 edge 16 is provided with small light emitting faces 18 at the ends of light transmitting, optical fibers 20 which branch from a common bundle 22 at the rear face 24 of the sole. The optical fibers 20 are embedded in the sole 12, which is composed of flexible transparent or translucent plastic material. The heel 14 is also composed of transparent plastic, but is hollow, FIG. 3; and contains a battery 24 powered flashlight 26; and an illuminated compartment 28. The front wall 30 of the heel 14 is provided with a hole 32 for containing the optical fiber bundle 22 projecting from the rear wall 24 of the sole 18, which mates with the front face 34 of heel 14.

Figure 5:
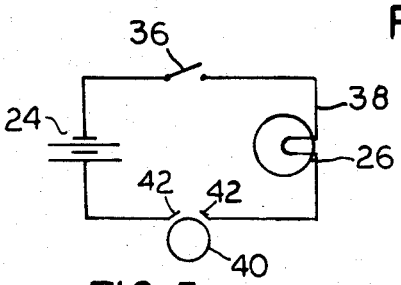
FIG. 5 is a circuit diagram.
Figure 4:
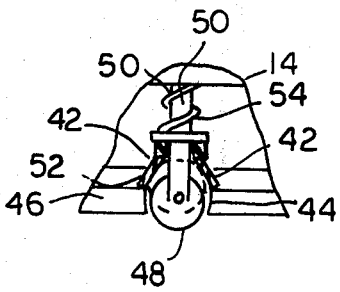
FIG. 4 is an enlarged detail in elevation of the pressure switch in the heel.

The front wall 34 of heel 18 is also provided with a manual switch 36 for, when closed, enabling the battery 34 lamp 56 energizing cirucit 38, FIG. 5, of the flashlight 24. Such circuit 38 contains a normally open pressure switch 40 comprising stationary contacts 42, 42 mounted in the heel 14 above an opening 44, FIG. 4, in the bottom wall 46 of the heel 14. Free to move vertically in the opening 44, is a roller-contact 48, which is pivoted to a vertical member 50 having a shoulder 52 that is urged downwardly by a compression spring 54. The spring 54 normally holds the switch 40 open, with the rim of roller 48 slightly below the bottom of the heel 14. Thus, when pressure on the roller 48, as when a disco dancer wearing the shoe, rests or taps heel 14 on the dance floor, not shown, roller 48 contacts inclined switch terminals 46, closing circuit 38, which energizes lamp 26, with the manual switch 36 closed. The lamp 26 flashes with each switch 40 closure.

The outer side wall 56 of heel 14 contains light port holes 58 that are covered with a transparent and/or translucent name plate or label 60, affixed to the heel 14 by brads 62, 62 bearing the wearer's identification.

Thus, every time the wearer of shoe 10, walks or taps the heel 14 on the dance floor; with the manual switch 28 closed; series circuit 38 in the heel 14, is energized by the closure of pressure switch 40, resulting in the flashing of lamp 26, and the illumination of identification label 60 on the heel side 56, and also illumination by optical conduction of the end faces 18 of the optical fibers 20, along the edge of sole 12. In some cases, if desired the name label 60 may be omitted.

I claim:

1. An illuminated shoe comprising, in combination
   - a heel having a cavity;
   - a source of light mounted in said cavity for furnishing light when energized;
   - energizing means connected to said source of light for furnishing electrical energy thereto;
   - a sole extending forwardly from said heel, said sole having an edge defining the outer perimeter thereof, said edge having at least one light emitting portion; and
   - at least one optical fiber embedded in said sole and having one end positioned to receive light from said source of light and a second end positioned near said light transmitting portion in said edge of said sole, whereby said light transmitting portion is illuminated when said source of light is energized.

2. An illuminated shoe as set forth in claim 1, wherein said edge of said sole has a plurality of light emitting portions; and wherein said at least one optical fiber comprise a plurality of optical fibers each having one end for receiving light from said source of light and a second end positioned near one of said light emitting portions for illuminating said light emitting portion.

3. An illuminated shoe as set forth in claim 2, wherein said sole is made of transparent plastic material.

4. An illuminated shoe as set forth in claim 2, wherein said sole is made of translucent plastic material.

5. An illuminated shoe as set forth in claim 1, wherein said heel has transverse holes for permitting the passage of light; wherein said source of light is a flashlight; and wherein said energizing means comprises a source of electrical energy and switch means interconnected between said source of electric energy and said source of light for connecting said source of energy to said source of light when closed and for disconnecting said source of energy from said light when open.

6. An illuminated shoe as set forth in claim 5, wherein said switch means comprises a switch contact roller; a vertical shaft carrying said roller at the lower end thereof;

a spring normally urging said shaft downwardly, with the roller a little below the bottom of said heel, and inclined stationary switch contacts above said contact roller, for engagement by said contact roller, to close said switch, when sufficient pressure is applied to said roller.

7. An illuminated shoe as set forth in claim 5, wherein said switch means comprises a manufally operated switch, and motion-dependent switch means connected in series with said manually operated switch for connecting said source of light to said energizing means only when said shoe is in a predetermined position relative to the floor.

8. An illuminated shoe as set forth in claim 1, wherein said heel has a side wall, said side wall having transverse holes extending from said cavity through said side wall for allowing the passage of light from said source of light through said side wall of said heel.

9. An illuminated dancing shoe as defined by claim 8, in which a nameplate of translucent plastic material is affixed to the side of said heel over said holes.

* * * * *